United States Patent [19]

von Schuckmann

[11] Patent Number: 4,995,521

[45] Date of Patent: Feb. 26, 1991

[54] STOPPER FOR INFUSION AND TRANSFUSION BOTTLES

[75] Inventor: Alfred von Schuckmann, Kevelaer, Fed. Rep. of Germany

[73] Assignee: Pohl GmbH & Co. KG, Karlsruhe, Fed. Rep. of Germany

[21] Appl. No.: 314,469

[22] Filed: Feb. 21, 1989

[30] Foreign Application Priority Data

Mar. 3, 1988 [DE] Fed. Rep. of Germany ..... 3806875

[51] Int. Cl.[5] ..... B05D 51/20

[52] U.S. Cl. ..... 215/249; 215/247; 215/355

[58] Field of Search ..... 215/247, 249, 294, 299, 215/300, 355

[56] References Cited

U.S. PATENT DOCUMENTS

| | | | |
|---|---|---|---|
| 2,526,622 | 10/1950 | Martin | 215/355 |
| 3,760,969 | 9/1973 | Shimamoto et al. | 215/247 |
| 4,205,754 | 6/1980 | Nielson et al. | 215/249 |
| 4,394,922 | 7/1983 | Wimmer | 215/300 |
| 4,416,661 | 11/1983 | Norman et al. | 215/247 X |
| 4,652,429 | 3/1987 | Konrad | 215/249 X |

FOREIGN PATENT DOCUMENTS

| | | | |
|---|---|---|---|
| 13299 | 11/1953 | Fed. Rep. of Germany | 215/247 |
| 1029131 | 5/1953 | France | 215/355 |
| 1106893 | 11/1955 | France | 215/355 |
| 42245 | 11/1937 | Netherlands | 215/355 |
| 397953 | 2/1966 | Switzerland | 215/355 |

*Primary Examiner*—Stephen Marcus

*Attorney, Agent, or Firm*—Martin A. Farber

[57] ABSTRACT

A closure stopper particularly for bottles or the like containing infusion solutions, having an elastic stopper part which is to be inserted in sealing fashion into the bottle neck and rests with a resting shoulder on the bottle neck and a cover part connected therewith. To obtain a solution of particularly optimal utility, cover part 15 coordinated with the stopper part by means of a clamping plug connection in the manner that the stopper part has a recess for the spreading insertion of a flange which protrudes from the cover part and is clamped between the stopper part and the cover part of a flanged cap.

13 Claims, 2 Drawing Sheets

STOPPER FOR INFUSION AND TRANSFUSION BOTTLES

FIELD AND BACKGROUND OF THE INVENTION

The invention relates to a closure stopper, in particular for bottles or the like containing infusion solutions, having an elastic stopper part which is to be inserted in sealing fashion into the bottle neck and rests with a resting shoulder on the bottle neck and a cover part connected therewith.

In the known solutions of this type (German OS No. 32 39 302), a plug-shaped basic body of plastic with a grip piece integrally formed thereon is provided, the basic body being covered with rubber elastic material in the region of its sealing surfaces. The cover part serves in this connection as a support part. In order to obtain the connection, the base body has a skeletal-like shape, the openings being so closed by injection-molding the other material around them that both materials penetrate into each other to form an interconnecting part. This solution is disadvantageous from the standpoint of manufacture, sealing and handling. The coordinating of a flanged cap is difficult. The total hygienic isolation of a puncture surface which is to be exposed for a removal cannula is not present and not possible. It has furthermore been found that all the rubber-like materials (thermoplastic rubber=TPR) entering into consideration from the standpoint of injection molding and sealing technology are not sufficiently inert over extremely long periods of use with respect to all corresponding liquids. There is also occasionally the disadvantage that upon the insertion of the cannula through the stopper for the removal, minute torn-off pieces fall into the bottle or the like where they can cause mechanical and, upon further transport through the probe tube, even medical complications.

SUMMARY OF THE INVENTION

It is the object of the present invention to develop a closure stopper of the type in question in such a manner that with simplified construction and while avoiding the above-mentioned disadvantages, a solution with increased advantages in use results.

According to the invention the cover part (e.g. 2) is combined with the stopper part (e.g. 1) by means of a clamping plug connection wherein the stopper part (1) has a recess (e.g. 14) for spreading entrance of a flange (e.g. 13) projecting from the cover part (2).

As a result of this development there is created a closure stopper which, despite simplified manufacture which is possible with large dimensional tolerances and preferably by the injection molding process, represents an optimal solution with respect to sealing and subsequent use until the insertion of the removal cannula. There is present an extremely simple but dependably pre-assembled unit of cover and stopper part with which the flanged cap can also be favorably coordinated. The cannula penetration surface—bottom of the conical space—is covered in absolutely hygienic manner. The flange, particularly in the form of an annular flange, stabilizes the stopper part and improves its sealing seat in the bottle. The bottle liquid no longer comes into contact with the rubber. The latter incorporates in improved manner the reserve of elastic restoring force for a sufficient sealing contact. Towards the inside of the bottle the entire TRP stopper-part surface is covered by a corresponding plastic, preferably polypropylene. The latter is absolutely inert with respect to the liquids of consideration for such infusion or transfusion bottles. The surrounding of the lower end edge of the stopper part by such a plastic and its termination at the corresponding place results, as has been found, even in the region of said edge, in an absolute tightness against the passage of the liquid up to the stopper. On the other hand, the remaining part of the wall surface of the stopper part which is applied snugly due to the restoring force results in the required absolutely airtight closure. As has been found, no broken-off parts pass into the inside of the bottle or the cannula on the insertion of the removal cannula. In particular, when the stopper part is produced by injection molding behind the prefabricated plastic covering, there even results the surprising effect that after removal of such a cannula which corresponds to the customary dimension, there is again present a completely tight closure. The bottle does not leak by itself, even when placed upside down. Upon the insertion of the removal cannula there predominately results only a pushing aside of the surface-connected materials and, due to the high elastic restoring force of the stopper material, there again results upon removal of the cannula a closure of the hole formed by the pushing aside which is sufficient for certain brief intermediate storage periods. The high degree of sealing in the region of the terminating edge of the plastic covering is favored if the plastic covering, in accordance with the invention, tapers towards the terminating end. The insertion is facilitated if, in accordance with the invention, the plastic covering is thin in the region of the cup bottom. The measure, which is in this connection simultaneously provided, namely to provide ribs on the bottom side, stabilizes, on the other hand, this area against too severe bending and thus elongation of the material, for instance upon the insertion of the removal cannula. A star-shaped arrangement of the corresponding ribs is essential in order to make this stabilization uniform. This shape of the ribs is also advantageous from a molding standpoint. The insertion can be effected more dependably with respect to visibility and manipulation if the cup bottom is conical directed toward the inside of the bottle. The connection of the cover cap to the stopper part via the corresponding flange results in a good coordination which even insures an improved holding when the closure stopper is inserted in the bottle. Due to this holding the tension force of the stopper part can also readily be assumed to be so great that this cover cap can without danger be used to hold the bottle. The corresponding fastening of the flanged cap also constitutes an optimal further development from the standpoint of utility. It furthermore assures the original closure; however, upon the carrying of the bottle it is not the sole or essential force-transmission bridge to the neck of the bottle; this is rather to a much greater extent the cover cap.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 1:
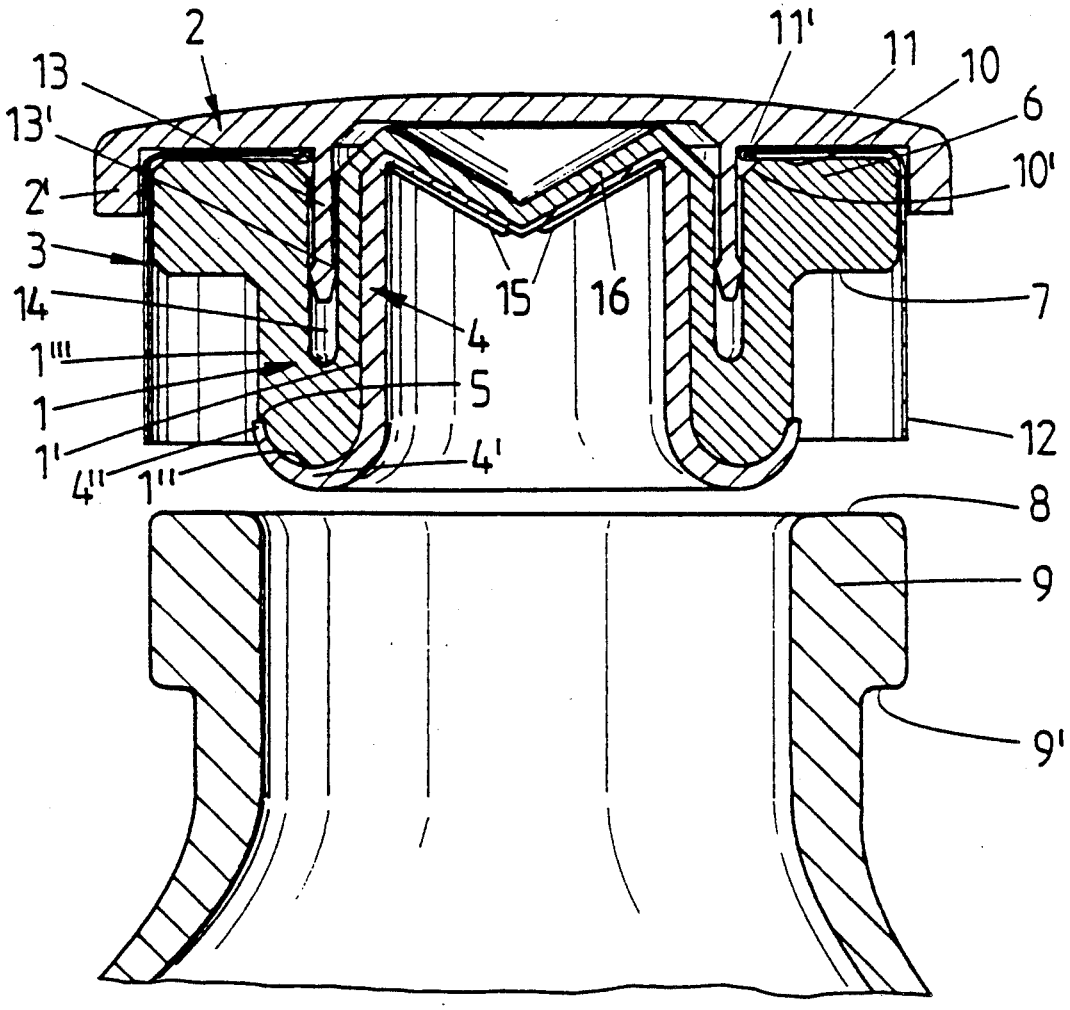
FIG. 1 is a longitudinal section of a stopper according to the invention and FIG. 2 is a bottom view of the closure stopper.
Figure 2:
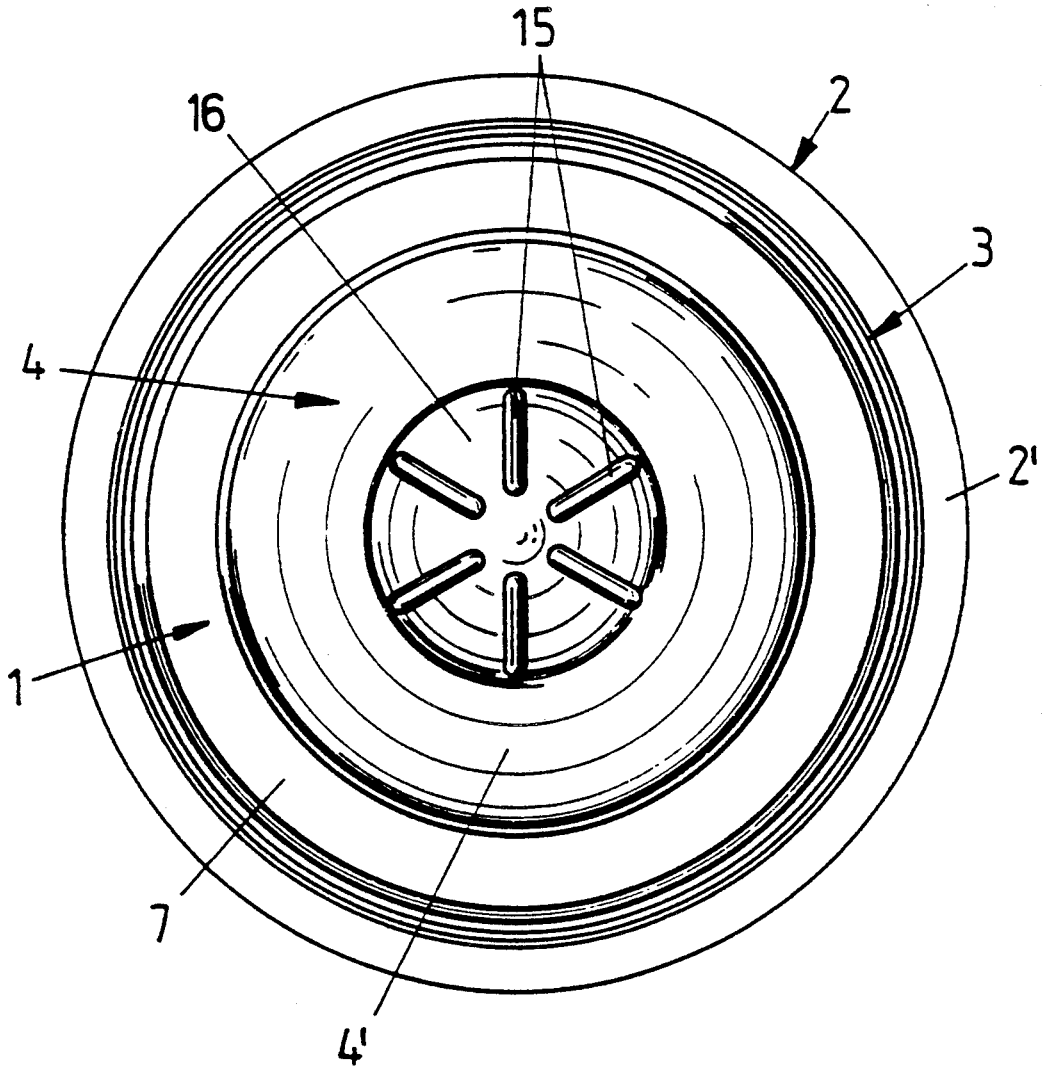

The closure stopper has a stopper part 1 made of TPR, a cover cap 2, a flanged cap 3 and a plastic covering 4. The latter preferably is made of polypropylene. The stopper part 1 is preferably made in a mold by injection molding behind the plastic covering 4.

The plastic covering 4 forms a closed-surface covering of the entire inside 1' of the stopper part 1 facing the inside of the bottle. For this purpose the plastic covering 4 surrounds with its bent region 4' the preferably curved end edge 1'' of the stopper part 1 and extends with its terminating end 4'' into the outer wall surface 1''' of the stopper part 1. The terminating end 4'' of the plastic covering 4 tapers towards the terminating end. One half of the end edge 5 of the terminating end 4'' is seated recessed into the wall surface 1''' of the stopper part 1.

A collar 6 adjoins the cup-shaped part of the stopper part 1. The collar forms with its bottom side the resting shoulder 7 which, in inserted condition, comes to rest on the end edge 8 of the bottle neck 9. The annular-shaped neck 11 of the flanged cap 3 rests on the topside 10 of said collar 6. A folded-over part 11' which rests in an oblique recess 10' reinforces this arrangement. The annular-shaped neck 11 of the flanged cap 3 is covered by the outer annular zone of the cover cap 2. The latter has a bent off rim 2' and, furthermore, protruding from the inside, a flange 13 which extends into an annular recess 14 of the cup-shaped central part of the stopper part 1. The flange 13 has in this case opposite oblique surfaces 13' which protrude outwardly. Upon compressing the stopper part 1 they result in an improved plug holding between the flange 13 and cover cap 2. With the closure stopper inserted into the bottle neck 9, the lower end region 12 of the flanged cap 3 is rolled in below the recessed edge 9' of the bottle neck.

The region 16 of the cup bottom of the stopper part 1 tapers conically toward the inside of the bottle. The surface area of the covering 4 which extends on the bottom side of the cup bottom 16 is made thin. It is provided with ribs 15 which are arranged in the shape of a star with respect to each other. The ends of the ribs 15 leave in the central region an area which is free of ribs.

I claim:

1. A closure stopper, in particular for bottles and the like containing infusion solutions, comprising an elastic stopper part which is insertable in sealing fashion into a bottle neck and which has a resting shoulder adapted to rest on the bottle neck, a cover part having a flange projecting downwardly therefrom, and the stopper part being formed with a recess extending substantially lower than said resting shoulder for entrance in said recess of said flange of the cover part extending downwardly beyond the resting shoulder and forming a removable clamping insertion connection with the stopper part, and a flanged cap having an annular-shaped neck, the neck extending crosswise to said flange and being clamped between a top side of the resting shoulder of the stopper part and a bottom side of said cover part, said flanged cap comprising an outer peripheral portion extending from said neck and having a lower end region for extending around the bottle neck and being rolled in below an inwardly recessed edge of the bottle neck for clamping said stopper part in cooperation with said neck, and sealing the stopper part in the bottle neck.

2. The closure cap according to claim 1, wherein said flange is formed as an annular flange, said recess is formed as an annular groove, said stopper part has a wall surface, a closed-surface covering which covers an inside of the stopper part facing the inside of the bottle, said covering, surrounds a lower end edge of the elastic stopper part, extending into the wall surface of the stopper part.

3. The closure cap according to claim 2, wherein said covering is a plastic covering having a terminating end, said covering tapers toward said terminating end, said terminating end extends into said wall surface.

4. The closure cap according to claim 2, wherein said stopper part is made of rubber.

5. The closure cap according to claim 1, wherein said annular-shaped neck of said flanged cap has a folded over part at a radially innermost circumferential edge of said neck, said folded over part is disposed in an oblique recess adjacent the open end of said recess in said stopper part.

6. The closure cap according to claim 1, wherein said cover part is formed as a cover cap completely extending over and gripping over a top side of said annular-shaped neck and having a peripheral bent-off rim in shape of an angular joint of rotational symmetry engaging over a top portion of the outer peripheral portion of said flanged cap.

7. A closure stopper, in particular for bottles and the like containing infusion solutions, comprising an elastic stopper part which is insertable in sealing fashion into a bottle neck and which has a resting shoulder adapted to rest on the bottle neck, a cover part connected to the stopper part, wherein said cover part being combined with the stopper part by means of a clamping plug connection wherein the cover part has a flange projecting therefrom, and the stopper part being formed with a recess which spreads upon entrance therein of said flange, said stopper part has a wall surface, a closed-surface covering which covers an inside of the stopper part facing the inside of the bottle, said covering, surrounds a lower end edge of the elastic stopper part, extending into the wall surface of the stopper part, said covering is a plastic covering which tapers toward a terminating end thereof which extends into said wall surface, said stopper part is shaped as a cup and has a cup bottom, and said plastic covering is thin in a region of said cup bottom and thereat has ribs on its side which faces the inside of the bottle.

8. The closure cap according to claim 7, wherein said ribs are arranged in star shape.

9. The closure cap according to claim 7, wherein said cup bottom forms a cone directed towards the inside of the bottle.

10. A closure stopper, in particular for bottles and the like containing infusion solutions, comprising an elastic stopper part which is insertable in a sealing fashion into a bottle neck and which has a resting shoulder adapted to rest on the bottle neck, a cover part having a flange projecting therefrom, and the stopper part being formed with a recess for entrance therein of said flange of the cover part for a clamping insertion connection with the stopper part, a flanged cap having an annular-shaped neck, the neck being clamped between a top side of the resting shoulder of the stopper part and said cover part, said flange is formed as an annular flange, said recess is formed as an annular groove, said stopper part has a wall surface, a closed-surface covering which covers an inside of the stopper part facing the inside of the bottle, said covering, surrounds a lower end edge of the elastic stopper part, extending into the wall surface of the stopper part, said stopper part is shaped as a cup and has a cup bottom, and said plastic covering is thin in a region of said cup bottom and thereat has ribs on its side which faces the inside of the bottle.

11. The closure cap according to claim 10, wherein said ribs are arranged in star shape.

12. The closure cap according to claim 10, wherein said cup bottom forms a cone directed towards the inside of the bottle.

13. A closure stopper, in particular for bottles and the like containing infusion solutions, comprising an elastic stopper part which is insertable in sealing fashion into a bottle neck and which has a resting shoulder adapted to rest on the bottle neck, a cover part having a flange projecting therefrom, and the stopper part being formed with a recess for entrance therein of said flange of the cover part for a clamping insertion connection with the stopper part, a flanged cap having an annular-shaped neck, the neck being clamped between a top side of the resting shoulder of the stopper part and said cover part, and said cover part is formed as a continuous cover cap completely extending over and gripping over the top side of said stopper part.

* * * * *